US005698298A

United States Patent [19]

Jackson et al.

[11] Patent Number: 5,698,298

[45] Date of Patent: *Dec. 16, 1997

[54] FIBROUS, NON-WOVEN POLYMERIC INSULATION

[75] Inventors: Fred Lee Jackson, Littleton; Kevin Patrick McHugh, Denver; John Stuart Robertson, Littleton; Joseph Rumiesz, Jr., Aurora, all of Colo.

[73] Assignee: Schuller International, Inc., Denver, Colo.

[ * ] Notice: The term of this patent shall not extend beyond the expiration date of Pat. No. 5,437,922.

[21] Appl. No.: 423,063

[22] Filed: Apr. 24, 1995

Related U.S. Application Data

[63] Continuation-in-part of Ser. No. 237,814, May 4, 1994, Pat. No. 5,437,922.

[51] Int. Cl.[6] ..... D04H 1/58; D04H 3/16

[52] U.S. Cl. ..... 428/198; 442/340; 442/341; 442/351; 442/415; 442/333; 428/297; 428/903; 428/903.3; 428/920

[58] Field of Search ..... 428/198, 224, 428/288, 297, 903, 903.3, 920; 442/333, 340, 341, 351, 415

[56] References Cited

U.S. PATENT DOCUMENTS

| | | | |
|---|---|---|---|
| 4,988,560 | 1/1991 | Meyer et al. | 428/297 |
| 4,992,327 | 2/1991 | Donovan et al. | 428/296 |
| 5,364,694 | 11/1994 | Okada et al. | 428/288 |
| 5,407,739 | 4/1995 | McCullough et al. | 428/287 |
| 5,437,922 | 8/1995 | Jackson et al. | 428/288 |

*Primary Examiner*—Helen Lee
*Attorney, Agent, or Firm*—Cornelius P. Quinn

[57] ABSTRACT

A fibrous, non-woven thermal insulation comprises synthetic polymeric resin microfibers, staple fibers and bonding fibers which are randomly oriented and randomly intermingled in a single layer. The microfibers comprise between 0% and 95% by weight virgin synthetic polymeric resin and between 5% and 100% by weight recycled polyethylene teraphthalate. In one embodiment the microfibers have an average diameter between 1 to 10 microns and comprise between 5% and 80% by weight of the insulation; the staple fibers have an average diameter between 10 and 30 microns and comprise between 5% and 90% by weight of the insulation; and the bonding fibers have an average diameter between 0.9 and 15 denier and comprise between 5% and 95% by weight of the insulation. The bonding fibers have thermoplastic surfaces with a lower temperature softening point than the microfibers and staple fibers and bond the fibers together to form the insulation material.

35 Claims, 1 Drawing Sheet

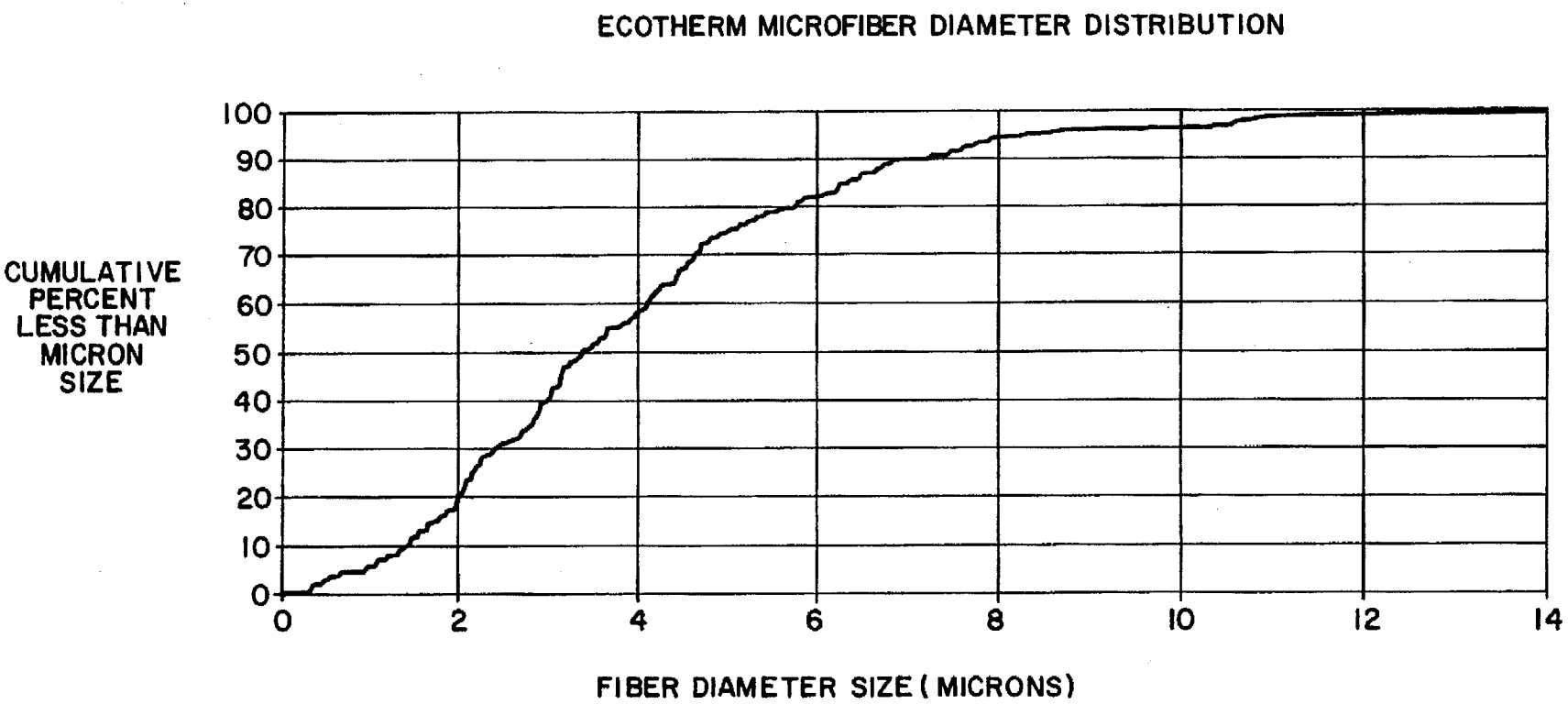
ECOTHERM MICROFIBER DIAMETER DISTRIBUTION
CUMULATIVE PERCENT LESS THAN MICRON SIZE
100
90
80
70
60
50
40
30
20
10
0
0
2
4
6
8
10
12
14
FIBER DIAMETER SIZE ( MICRONS)

FIBROUS, NON-WOVEN POLYMERIC INSULATION

This patent application is a continuation-in-part of U.S. application Ser. No. 08/237,814, filed May 4, 1994, entitled FIBROUS, NON-WOVEN POLYMERIC INSULATION, now U.S. Pat. No. 5,437,922.

BACKGROUND OF THE INVENTION

The present invention is directed to a fibrous polymeric insulation and, in particular, to an insulation for clothing and the like, comprising a non-woven blend of polymeric fibers including microfibers made in part from a recycled polymer.

A wide variety of natural and synthetic thermal insulating materials are used in outer wear garments, such as ski parkas, sleeping bags and similar items used in winter and other outdoor sporting, hiking and camping activities. To be commercially suitable for such applications, such insulating materials must exhibit insulating properties equivalent to down. In addition, such materials should be light in weight, to keep the insulated garments or sleeping bags as light as possible for backpacking; and resilient to maintain their insulating properties after repeated compressions and expansions caused by packing and unpacking such items. These materials should also retain their thermal insulating properties even when the materials become wet.

It is also desirable to keep the costs of such thermal insulating materials as low as possible and it would be highly beneficial to society if recycled materials such as plastics could be used in this type of insulating product to help reduce the waste disposal problems currently presented by plastic materials.

SUMMARY OF THE INVENTION

The unique, non-woven, fibrous polymeric thermal insulating material of the present invention meets all of the performance criteria discussed above and in addition provides a relatively inexpensive insulating material made, in part, from recycled plastic waste. The thermal insulating material of the present invention comprises a single layer of non-woven, randomly oriented and randomly intermingled finite length microfibers, staple fibers and bonding fibers.

The finite length microfibers used in the insulating material of the present invention have a composition of between 0% and 95% by weight virgin polymer, such as polybutylene teraphthalate, and between 5% and 100% by weight recycled polyethylene teraphthalate. By using recycled plastics such as polyethylene teraphthalate in the microfiber composition, the present invention provides a new and unique way of turning waste materials into a useful product which, in of itself, is highly beneficial to society.

The polymeric microfibers used in the thermal insulating material of the present invention, taken as a whole, have an average fiber diameter between 1 and 10 microns and preferably, between 2 and 4 microns with about 30% to about 40% of the microfibers having diameters of less than 3 microns. As the average fiber diameter of the microfibers in the insulating material of the present invention decreases, the thermal insulating properties of the insulating material generally improve. As the average fiber diameter of the microfibers in the insulating material of the present invention increases, the thermal insulating properties of the insulating material are reduced and, at average fiber diameters of over 8 microns, the thermal insulating properties of the insulating material become unacceptable for applications, such as, ski parkas, sleeping bags, etc. The polymeric microfibers normally comprise between 35% and 80% by weight of the thermal insulating material and can comprise as low as 05% by weight of the thermal insulating material.

The staple polymeric fibers used in the thermal insulating material of the present invention provide the thermal insulating material with loft, strength and resiliency. Thus, when the thermal insulating material of the present invention is subjected to repeated compressions and expansions during service, the insulating material retains its thermal insulating properties. To provide the insulating material of the present invention with the loft and resilience required during service, the staple fibers used in the insulating material, taken as a whole, have an average fiber diameter ranging from 10 to 30 microns so that the fibers are neither too limp nor too stiff to provide the necessary loft and resilience required for the product. The staple polymeric fibers normally comprise between 15% and 60% by weight of the thermal insulating material and can comprise from 0% to 90% by weight of the thermal insulating material.

The finite length thermoplastic bonding fibers comprise normally between 5% and 25% by weight and can comprise between 5% and 90% by weight of the non-woven thermal insulating material of the present invention. The bonding fibers have thermoplastic surfaces with a lower temperature softening point than the softening points of the insulation microfibers and the staple fibers. To provide the surface area required for the effective bonding of the microfibers and staple fibers to form the thermal insulating material, the thermoplastic bonding fibers, taken as a whole, have an average fiber diameter ranging from 0.9 denier to 15 denier. When the thermal insulating material is less than 5% by weight bonding fibers, the insulating material lacks the integrity required for most applications. Increasing the percentage by weight of bonding fibers in the thermal insulating material over 25% does not appreciably improve the integrity of the thermal insulating material and for most applications, the bonding fibers do not have to exceed 20% by weight of the thermal insulating material to give the thermal insulating material the integrity and strength required for its intended applications as an insulation in outer-wear garments, sleeping bags, etc. Thus, the percentage by weight of the bonding fibers in the insulation material will be increased to over 25% only as deemed desirable for certain applications.

In one embodiment of the present invention, where the additional loft and resilience provided by the staple fibers are not required for the intended use, the thermal insulating material comprise only insulation microfibers and bonding fibers.

BRIEF DESCRIPTION OF THE DRAWING

The FIGURE is a plot of the microfiber diameter distribution, measured optically, of the microfibers used in the fibrous, non-woven polymeric insulation of the present invention.

DESCRIPTION OF THE PREFERRED EMBODIMENTS

The non-woven fibrous thermal insulating material of the present invention comprises finite length, synthetic polymeric resin microfibers (made, in part, from recycled polyethylene teraphthalate); staple synthetic polymeric resin fibers; and finite length thermoplastic bonding fibers which bond the fibers of the non-woven thermal insulating mat or blanket together. The insulation microfibers, the staple fibers and the bonding fibers are not segregated into separate layers within the insulating material. Rather the insulation microfibers, the staple fibers and the bonding fibers are all randomly oriented and intermingled in a single layer of thermal insulating material.

The finite length, synthetic polymeric resin microfibers preferably comprise virgin polybutylene teraphthalate and recycled polyethylene teraphthalate. The broad range composition of the insulation microfibers is from 0% to 95% by weight virgin polybutylene teraphthalate and from 5% to 100% by weight recycled polyethylene teraphthalate. However, the preferred range composition of the insulation microfibers is from 30% to 70% by weight virgin polybutylene teraphthalate and from 30% to 70% by weight recycled polyethylene teraphthalate with the most preferred insulation microfiber composition comprising from 45% to 55% by weight virgin polybutylene teraphthalate and from 45% to 55% by weight recycled polyethylene teraphthalate.

Virgin polybutylene teraphthalate is not the only virgin synthetic polymeric resin that can be used in the composition of the insulation microfibers. Virgin polycarbonate can be substituted for the virgin polybutylene teraphthalate in the composition. However, virgin polycarbonate is more expensive than the polybutylene teraphthalate and, accordingly, the polybutylene teraphthalate is preferred. However, nylon is harder to fiberize and is more expensive than polybutylene teraphthalate. Accordingly, the polybutylene teraphthalate is preferred. Polyethylene teraphthalate can also be substituted for the polybutylene teraphthalate.

The properties of the synthetic polymeric resin insulation microfibers are adversely affected when the percentage by weight of recycled polyethylene teraphthalate in the fibers is too great. As the percentage by weight of recycled polyethylene teraphthalate in the microfiber composition increases above 75%, the microfibers exhibit excessive shrinkage when subjected to temperatures above 110° Centigrade and become progressively more brittle, making the fibers less acceptable for the insulating material of the present invention which must be heated to a temperature of 110° Centigrade or more to effect the bonding of the fibers in the insulating material. When too much virgin polybutylene teraphthalate is used in the composition of the microfibers, the insulation microfibers become more expensive without appreciably improving the physical properties of the fibers and the amount of recycled polyethylene teraphthalate in the composition is reduced. Since one objective of the present invention is to recycle as much polyethylene teraphthalate as possible without adversely affecting the performance of the thermal insulating microfibers, the insulation microfibers which most fulfill the objects of and provide the advantages of the present invention are those insulation microfibers having a composition of about 45% to about 55% by weight virgin polybutylene teraphthalate and about 45% to about 55% by weight recycled polyethylene teraphthalate. However, even through the insulation microfibers exhibit progressively greater shrinkage and brittleness when they contain above 75% by weight recycled polyethylene teraphthalate and the physical properties of the microfibers are such that the microfibers are no longer suitable for use as insulation microfibers in the preferred insulating material of the present invention, such insulation microfibers can be used for certain insulating applications.

The synthetic polymeric resin insulation microfibers used in the insulating material of the present invention, taken as a whole, have an average fiber diameter of from 1 to 10 microns and preferably, for the best insulating properties at a relatively economical cost, the insulation microfibers have an average fiber diameter of from about 2 to about 4 microns. As shown in the FIGURE, the microfibers, used in the non-woven insulating material of the present invention, range in diameter from less than 1 micron to more than 8 microns. While the average fiber diameter of the microfibers, taken as a whole, in the preferred embodiments is from about 2 microns to about 4 microns, the significant percentage of very fine diameter microfibers present (between 30% and 40% of the microfibers are less than 3 microns in diameter and between 15% and 20% of the microfibers are less than 2 microns in diameter) enhances the insulating properties of the non-woven insulating material of the present invention. The average length of the insulation microfibers is from about ½ of an inch to 2 inches.

The synthetic polymeric resin staple fibers used in the non-woven, fibrous insulating material of the present invention, are formed from a synthetic polymeric resin, such as, virgin or recycled polyethylene teraphthalate, virgin or recycled polyethylene, virgin or recycled polypropylene, polybutylene teraphthalate, virgin or recycled polyester and nylon. The staple fibers, taken as a whole, range in average fiber diameter from 10 to 30 microns and range in length from about ½ of an inch to about 3 inches. Preferably, to provide the insulating material with the desired loft and strength, the average fiber diameter of the staple fibers, taken as a whole, is from about 12 to about 25 microns and the average length of the staple fibers is from about 1 to about 2 inches.

The synthetic polymeric resin bonding fibers used in the non-woven, fibrous insulating material of the present invention have thermoplastic surfaces with a lower temperature softening point than the softening points of either the insulating microfibers or the staple fibers. The bonding fibers are normally sheathed fibers having polypropylene or polypropylene teraphthalate cores coated with a polyolifin or a polypropylene teraphthalate material having a lower softening point than the insulation microfibers and the staple fibers. While polymers of the same type, such as, polyethylene teraphthalate, may be used as the surface material for the bonding fibers as well as in the insulation microfibers and/or the staple fibers, the specific molecular weight of the polymer selected for the bonding material is chosen to give the bonding material a lower softening point than either the insulation microfibers or the staple fibers. The lower temperature softening point of the surfaces of the thermoplastic bonding fibers allows the surfaces of the bonding fibers to become tacky, when the insulating material is heated, to effect the bonding of the fibers within the thermal insulating material of the present invention without adversely affecting the integrity of the insulation microfibers or the staple fibers in the insulating material. Preferably the softening point of the surfaces of the bonding fibers, which is typically between 110° and 130° Centigrade, is at least 10° to 15° Centigrade lower than the softening point of either the polymeric microfibers or the polymeric staple fibers.

The bonding fibers, taken as a whole, have an average fiber diameter ranging from 0.9 to 15 denier and an average length ranging from about ½ of an inch to about 3 inches. Preferably, to provide the desired surface area at a relatively economical cost for effecting the bonding of the fibers in the insulating material, the bonding fibers, taken as a whole, have an average fiber diameter ranging from about 2 to about 6 denier and an average length ranging from about 1 to about 2 inches.

The non-woven, fibrous thermal insulating material of the present invention normally comprises: 5% to 80% by weight insulation microfibers; 5% to 90% by weight staple fibers; and 5% to 90% by weight bonding fibers. In the preferred embodiment of the present invention the thermal insulating material comprises: 40% to 60% by weight insulation microfibers; 25% to 55% by weight staple fibers; and 5% to 20% by weight bonding fibers. In one preferred embodiment, the thermal insulating material comprises about 50% insulation microfibers; about 35% staple fibers; and about 15% bonding fibers. The insulation microfibers, the staple fibers and the bonding fibers are randomly oriented and randomly intermingled throughout the non-woven thermal insulating material. The bonding fibers are bonded to the insulation microfibers and the staple fibers at the points of intersection of the bonding fibers with the other randomly oriented fibers in the insulating material.

The insulation microfibers, the staple fibers and the bonding fibers are blended together in a conventional carding machine or a similar machine, such as a RANDO-WEBBER machine made by Rando Machine Corporation of Macedon, N.Y. Once the blanket or mat of non-woven, randomly oriented and randomly intermingled insulation microfibers, staple fibers and bonding fibers is formed in the carding process, the blanket or web of insulating material is heated to the softening point of the thermoplastic surfaces of the bonding fibers to bond the fibers of the insulation blanket or mat together to form the finished insulation product which typically has a density comparable to that of down, e.g., less than one pound per cubic foot.

The following table shows the thermal performance of insulating blankets or mats of the present invention at different densities.

| DENSITY PCF | THERMAL CONDUCTIVITY (BTU-in/hr-ft$^2$-°F.) |
|---|---|
| 1.97 | 0.238 |
| 1.11 | 0.248 |
| 0.93 | 0.264 |
| 0.598 | 0.304 |

In another embodiment of the present invention, the thermal insulating material comprises between 80% and 95% by weight insulation microfibers and between 5% and 20% by weight bonding fibers or between 80% and 90% by weight insulation microfibers, between 5% and 15% by weight staple fibers and between 5% and 15% by weight bonding fibers. The fibers are randomly intermingled and randomly oriented to form a blanket or mat in a carding machine and heated to bond the fibers together as described above in connection with the embodiment of the invention which includes the staple fibers to impart additional loft and strength to the thermal insulating material that is not required for this embodiment.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A non-woven fibrous blanket of thermal insulating material comprising:

insulation microfibers having a composition comprising between 30% and 70% by weight virgin synthetic polymeric resin and between 30% and 70% by weight recycled polyethylene teraphthalate; said insulation microfibers having a softening point; said insulation microfibers comprising between 5% and 80% by weight of the fibrous thermal insulating material;

synthetic polymeric resin staple fibers; said staple fibers having a softening point; said staple fibers comprising between 5% and 90% by weight of the fibrous thermal insulating material;

synthetic polymeric resin bonding fibers comprising between 5% and 90% by weight of the fibrous thermal insulating material; said bonding fibers having thermoplastic surfaces with a lower temperature softening point than the softening points of said insulation microfibers and said staple fibers; and said insulation microfibers, said staple fibers, and said bonding fibers being randomly oriented and randomly intermingled in a blanket; and said bonding fibers bonding said insulation microfibers, said staple fibers and said bonding fibers together to form said blanket.

2. The thermal insulating material of claim 1, wherein: said virgin synthetic polymeric resin of said insulation microfibers is selected from a group consisting of polybutylene teraphthalate, polyethylene teraphthalate, polycarbonate, and nylon.

3. The thermal insulating material of claim 2, wherein: said insulation microfibers, taken as a whole, have an average fiber diameter between 1 and 10 microns; said staple fibers, taken as a whole, have an average fiber diameter between 10 and 30 microns; and said bonding fibers, taken as a whole, have an average fiber diameter between 0.9 and 15 denier.

4. The thermal insulating material of claim 2, wherein: said insulation microfibers, taken as a whole, have an average fiber diameter between 2 and 4 microns; said staple fibers, taken as a whole, have an average fiber diameter between 12 and 25 microns; and said bonding fibers, taken as a whole, have an average fiber diameter between 2 and 6 denier.

5. The thermal insulating material of claim 1, wherein: said insulation microfibers comprise between 40% and 60% by weight of said thermal insulating material; said staple fibers comprise between 25% and 55% by weight of said thermal insulating material; and said bonding fibers comprise between 5% and 20% by weight of said thermal insulating material.

6. The thermal insulating material of claim 5, wherein: said virgin synthetic polymeric resin of said insulation microfibers is selected from a group consisting of polybutylene teraphthalate, polyethylene teraphthalate, polycarbonate, and nylon.

7. The thermal insulating material of claim 6, wherein: said insulation microfibers, taken as a whole, have an average fiber diameter between 1 and 10 microns; said staple fibers, taken as a whole, have an average fiber diameter between 10 and 30 microns; and said bonding fibers, taken as a whole, have an average fiber diameter between 0.9 and 15 denier.

8. The thermal insulating material of claim 6, wherein: said insulation microfibers, taken as a whole, have an average fiber diameter between 2 and 4 microns; said staple fibers, taken as a whole, have an average fiber diameter between 12 and 25 microns; and said bonding fibers, taken as a whole, have an average fiber diameter between 2 and 6 denier.

9. The thermal insulating material of claim 1, wherein: said insulation microfibers have a composition comprising between 45% and 55% by weight virgin synthetic polymeric resin and between 45% and 55% by weight recycled polyethylene teraphthalate.

10. The thermal insulating material of claim 9, wherein: said virgin synthetic polymeric resin of the insulation microfibers is selected from a group consisting of polybutylene teraphthalate, polyethylene teraphthalate, polycarbonate and nylon.

11. The thermal insulating material of claim 10, wherein: said insulation microfibers, taken as a whole, have an average fiber diameter between 1 and 10 microns; said staple fibers, taken as a whole, have an average fiber diameter between 10 and 30 microns; and said bonding fibers, taken as a whole, have an average fiber diameter between 0.9 and 15 denier.

12. The thermal insulating material of claim 10, wherein: said insulation microfibers, taken as a whole, have an average fiber diameter between 2 and 4 microns; said staple fibers, taken as a whole, have an average fiber diameter between 12 and 25 microns; and said bonding fibers, taken as a whole, have an average fiber diameter between 2 and 6 denier.

13. The thermal insulating material of claim 9, wherein: said insulation microfibers comprise between 40% and 60% by weight of said thermal insulating material; said staple fibers comprise between 25% and 55% of said thermal insulating material; and said bonding fibers comprise between 5% and 20% by weight of said thermal insulating material.

14. The thermal insulating material of claim 13, wherein: said virgin synthetic polymeric resin of said insulation microfibers is selected from a group consisting of polybutylene teraphthalate, polyethylene teraphthalate, polycarbonate, and nylon.

15. The thermal insulating material of claim 14, wherein: said insulation microfibers, taken as a whole, have an average fiber diameter of between 1 and 10 microns; said staple fibers, taken as a whole, have an average fiber diameter between 10 and 30 microns; and said bonding fibers, taken as a whole, have an average fiber diameter between 0.9 and 15 denier.

16. The thermal insulating material of claim 14, wherein: said insulation microfibers, taken as a whole, have an average fiber diameter between 2 and 4 microns; said staple fibers, taken as a whole, have an average fiber diameter between 12 and 25 microns; and said bonding fibers, taken as a whole, have an average fiber diameter between 2 and 6 denier.

17. A non-woven fibrous blanket of thermal insulating material comprising:

insulation microfibers having a composition comprising between 25% and 95% by weight virgin synthetic polymeric resin and between 5% and 75% by weight recycled polyethylene teraphthalate; said insulation microfibers having a softening point; said insulation microfibers comprising between 80% and 95% by weight of the fibrous thermal insulating material;

synthetic polymeric resin bonding fibers comprising between 5% and 20% by weight of the fibrous thermal insulating material; said bonding fibers having thermoplastic surfaces with a lower temperature softening point than the softening point of the insulation microfibers; and said insulation microfibers and said bonding fibers being randomly oriented and randomly intermingled in a blanket; and said bonding fibers bonding said insulation microfibers and said bonding fibers together to form said blanket.

18. The thermal insulating material of claim 17, wherein: said virgin synthetic polymeric resin of the insulation microfibers is selected from a group consisting of polybutylene teraphthalate, polyethylene teraphthalate, polycarbonate and nylon.

19. The thermal insulating material of claim 18, wherein: said insulation microfibers, taken as a whole, have an average fiber diameter between 1 and 10 microns; said bonding fibers, taken as a whole, have an average fiber diameter between 0.9 and 15 denier.

20. The Thermal insulating material of claim 18, wherein: said insulation microfibers, taken as a whole, have an average fiber diameter between 2 and 4 microns; said bonding fibers, taken as a whole, have an average fiber diameter between 2 and 6 denier.

21. The thermal insulating material of claim 18, wherein: said insulation microfibers, taken as a whole, have an average fiber diameter between 1 and 10 microns; said bonding fibers, taken as a whole, have an average fiber diameter between 0.9 and 15 denier and comprise between 5% and 15% by weight of the fibrous thermal insulating material; and said fibrous thermal insulating material including between 5% and 15% by weight staple fibers with said staple fibers, taken as a whole, having an average fiber diameter between 10 and 30 microns.

22. The thermal insulating material of claim 21, wherein: said insulation microfibers, taken as a whole, have an average fiber diameter between 2 and 4 microns; said staple fibers, taken as a whole, have an average fiber diameter between 12 and 25 microns; and said bonding fibers, taken as a whole, have an average fiber diameter between 2 and 6 denier.

23. The thermal insulating material of claim 17, wherein: said insulation microfibers have a composition comprising between 30% and 70% by weight virgin synthetic polymeric resin and between 30% and 70% by weight recycled polyethylene teraphthalate.

24. The thermal insulating material of claim 23, wherein: said virgin synthetic polymeric resin of the insulation microfibers is selected from a group consisting of polybutylene teraphthalate, polyethylene teraphthalate, polycarbonate and nylon.

25. The thermal insulating material of claim 24, wherein: said insulation microfibers, taken as a whole have an average fiber diameter between 1 and 10 microns; and said bonding fibers, taken as a whole, have an average fiber diameter between 0.9 and 15 denier.

26. The thermal insulating material of claim 24, wherein: said insulation microfibers, taken as a whole, have an average fiber diameter between 2 and 4 microns; and said bonding fibers, taken as a whole, have an average fiber diameter between 12 and 25 microns.

27. The thermal insulating material of claim 24, wherein: said insulation microfibers, taken as a whole, have an average fiber diameter between 1 and 10 microns; said bonding fibers, taken as a whole, have an average fiber diameter between 0.9 and 15 denier and comprise between 5% and 15% by weight of the fibrous thermal insulation material; and said fibrous thermal insulating material including between 5% and 15% by weight staple fibers with said staple fibers, taken as a whole, having an average fiber diameter between 10 and 30 microns.

28. The thermal insulating material of claim 27, wherein: said insulation microfibers, taken as a whole, have an average fiber diameter between 2 and 4 microns; said staple fibers, taken as a whole, have an average fiber diameter between 12 and 25 microns; and said bonding fibers, taken as a whole, have an average fiber diameter between 2 and 6 denier.

29. The thermal insulating material of claim 17, wherein: said insulation microfibers have a composition comprising between 45% and 55% by weight virgin synthetic polymeric resin and between 45% and 55% by weight recycled polyethylene teraphthalate.

30. The thermal insulating material of claim 29, wherein: said virgin synthetic polymeric resin of said insulation microfibers is selected from a group consisting of polybutylene teraphthalate, polyethylene teraphthalate, polycarbonate and nylon.

31. The thermal insulating material of claim 30, wherein: said insulation microfibers, taken as a whole, have an average fiber diameter between 1 and 10 microns; and said bonding fibers, taken as a whole, have an average fiber diameter between 0.9 and 15 denier.

32. The thermal insulating material of claim 30, wherein: said insulation microfibers, taken as a whole, have an average fiber diameter between 2 and 4 microns; and said bonding fibers, taken as a whole, have an average fiber diameter between 2 and 6 denier.

33. The thermal insulating material of claim 30, wherein: said insulation microfibers, taken as a whole, have an average fiber diameter between 1 and 10 microns; said bonding fibers, taken as a whole, have an average fiber diameter between 0.9 and 15 denier and comprise between 5% and 15% by weight of the fibrous thermal insulating material; and said fibrous thermal insulating material including between 5% and 15% by weight staple fibers with said staple fibers, taken as a whole, having an average fiber diameter between 10 and 30 microns.

34. The thermal insulating material of claim 33, wherein: said insulation microfibers, taken as a whole, have an average fiber diameter between 2 and 4 microns; said staple fibers, taken as a whole, have an average fiber diameter between 12 and 25 microns; and said bonding fibers, taken as a whole, have an average fiber diameter between 2 and 6 denier.

35. The thermal insulating material of claim 1, wherein: said staple fibers are made of a recycled synthetic polymeric resin.

* * * * *